United States Patent [19]

Compeau et al.

[11] Patent Number: 4,823,059

[45] Date of Patent: Apr. 18, 1989

[54] CONTROL APPARATUS FOR A COMPARTMENT PANEL PULL DOWN MECHANISM

[75] Inventors: David E. Compeau, Mt. Clemens; Lloyd W. Rogers, Utica; Ronald J. Pyszel, Sterling Heights; Walter C. Chapman, Allenton, all of Mich.

[73] Assignee: General Motors Corporation, Detroit, Mich.

[21] Appl. No.: 143,780

[22] Filed: Jan. 14, 1988

[51] Int. Cl.[4] ..... E05B 47/00; E05B 65/19; E05F 15/10

[52] U.S. Cl. ..... 318/454; 318/466; 296/76; 292/341.16

[58] Field of Search ..... 318/452, 453, 454, 455, 318/466, 469, 476; 49/280; 70/240, 241, 279; 292/201, 341.16, DIG. 43; 307/9, 10 R; 296/76

[56] References Cited

U.S. PATENT DOCUMENTS

| | | | |
|---|---|---|---|
| 2,896,990 | 7/1959 | Garvey et al. | 292/229 |
| 2,903,288 | 9/1959 | Joachim et al. | 292/341.16 |
| 2,916,319 | 12/1959 | Bois | 292/341.16 |
| 2,943,880 | 7/1960 | Joachim et al. | 292/201 |
| 2,994,550 | 8/1961 | White | 292/341.16 |
| 3,343,303 | 9/1967 | Wanlass | 49/280 |
| 3,403,934 | 10/1968 | Butts | 292/341.16 |
| 3,565,477 | 2/1971 | Gionet et al. | 70/240 X |
| 3,835,678 | 9/1974 | Meyer et al. | 70/241 |
| 4,307,907 | 12/1981 | Barrowman et al. | 292/DIG. 43 X |
| 4,544,189 | 10/1985 | Fiordellisi et al. | 292/50 |
| 4,739,585 | 4/1988 | Pickles | 49/280 |
| 4,746,153 | 5/1988 | Compeau et al. | 292/DIG. 43 X |

*Primary Examiner*—Bentsu Ro

*Attorney, Agent, or Firm*—Mark A. Navarre

[57] ABSTRACT

A control for a motorized deck lid pull down mechanism which does not require the use of mechanically activated limit switches for detecting deck lid positions or the presence of closing or sealing obstructions. Detection of specified pull down conditions as well as the presence of deck lid obstructions is achieved by monitoring the magnitude of motor current in relation to various predefined motor current thresholds. Engagement of the deck lid with obstructions during the pull down sequence will cause the motor current to exceed the closing and sealing thresholds, terminating or reversing the respective function.

8 Claims, 5 Drawing Sheets

CONTROL APPARATUS FOR A COMPARTMENT PANEL PULL DOWN MECHANISM

This invention relates to a vehicle deck lid panel pull down mechanism, and more particularly to the control thereof.

BACKGROUND OF THE INVENTION

The present invention is directed to the control of an automatic deck lid panel pull down mechanism. Generally known in the automotive art, such mechanisms sequentially perform closing and sealing functions. The closing function involves bringing the deck lid to a partially closed position to mutually couple a latch bolt mounted on the deck lid and a vertically extended striker mounted on the vehicle body. The sealing function follows the closing function and involves bringing the deck lid to a fully closed position by vertically moving the striker to a retracted position. If desired, a single motorized drive unit may be employed to perform both closing and sealing functions.

Control of a deck lid pull down mechanism of the above type requires the detection of certain deck lid positions. In a typical pull down operation, for example, it is necessary to detect attainment of both the partially closed and the fully closed positions. Detection of the partially closed position is needed to terminate the closing function and initiate the sealing function; detection of the fully closed position is needed to terminate the sealing function. To detect such deck lid positions, mechanically activated limit switches are generally employed.

In addition to position detection, the pull down control should be capable of detecting the presence of an obstruction which prevents the deck lid from properly closing or sealing so that operation of the mechanism may be terminated or reversed. Typically, additional mechanically activated limit switches are required to perform such detection.

SUMMARY OF THE PRESENT INVENTION

The present invention is directed to an improved control unit for a motorized deck lid pull down mechanism which does not require the use of mechanically activated limit switches for detecting deck lid positions or the presence of closing or sealing obstructions.

According to the present invention, detection of the specified pull down conditions as well as the presence of deck lid obstructions is performed by monitoring the magnitude of electric current supplied to the motorized drive unit in relation to various predefined current magnitude thresholds. Achievement of the partially closed deck lid position is indicated when the motor current exceeds a closing threshold; achievement of the fully closed deck lid position is indicated when the motor current exceeds a sealing threshold. Engagement of the deck lid with obstructions during the pull down sequence will cause the motor current to exceed the closing and sealing thresholds, terminating or reversing the respective function. Current monitoring at the initiation of the closing and sealing functions is momentarily inhibited to mask the associated motor inrush current.

The control of the present invention is described herein in connection with a pull down mechanism which is the subject of co-pending patent application Ser. No. 143,779, filed Jan. 14, 1988, and assigned to the assignee of the present invention. However, it should be understood that the control is equally applicable to other pull down mechanisms exhibiting the general operating characteristics described above.

BRIEF DESCRIPTION OF THE DRAWINGS

FIG. 2 is a side elevation view of the motorized drive unit; FIG. 3 is a sectional view taken in the direction of arrows 3—3 of FIG. 2; FIG. 4 is a sectional view taken in the direction of arrows 4—4 of FIG. 1; and FIG. 5 is an elevation view in the direction of arrows 5—5 of FIG. 4.

Figure 1:
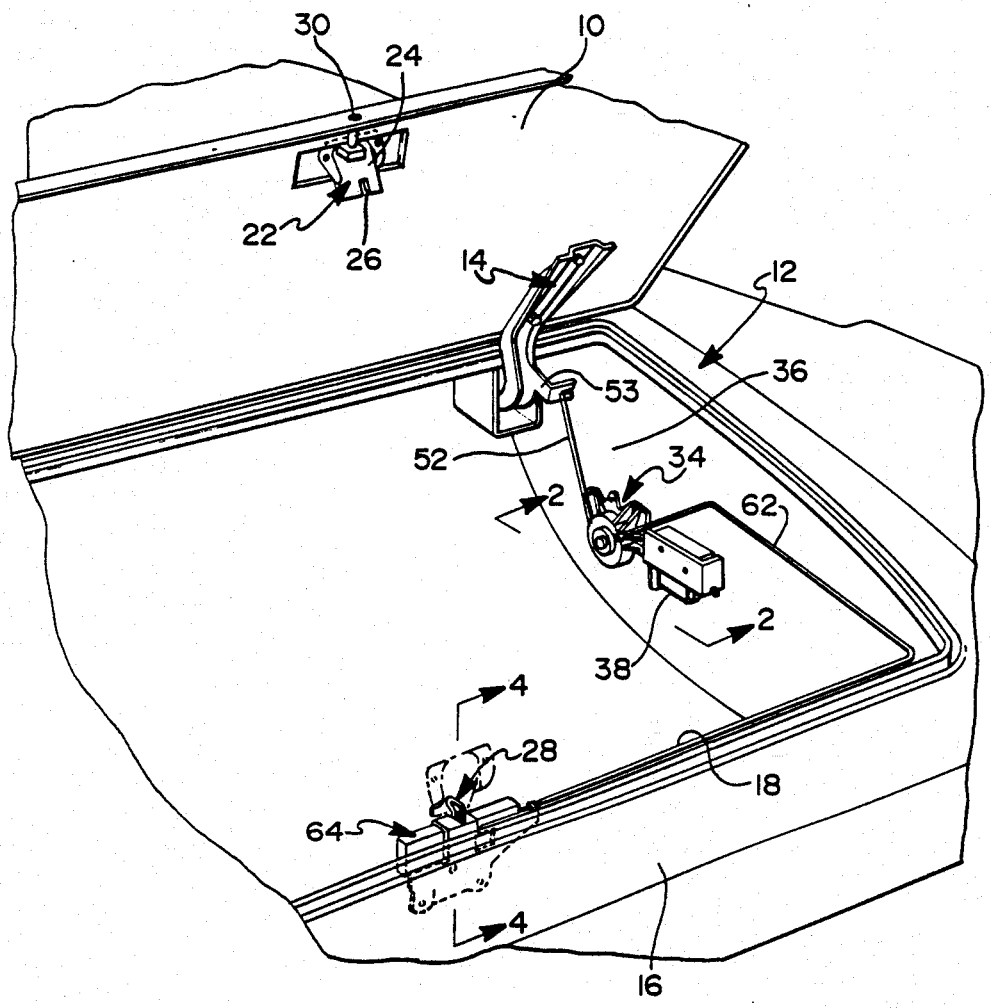
FIG. 1 is a perspective view of a vehicle body compartment, including a motorized pull down mechanism and a control unit according to this invention.

FIGS. *6a–6b* depict a circuit diagram of the control unit depicted in FIG. 1.

Figure 7:
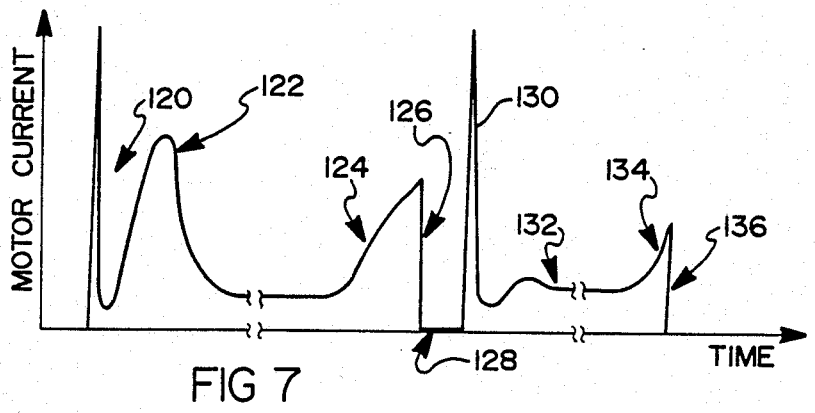

FIG. 7 graphically depicts the electrical current supplied to the motorized drive unit of FIG. 1 in the course of a typical pull down sequence.

DESCRIPTION OF THE PREFERRED EMBODIMENT

Referring to FIG. 1, a deck lid panel 10 is mounted on a vehicle body 12 by a pair of hinges, one of which is shown at 14. Body panel 16 of the vehicle body 12 defines a compartment opening 18 which is opened and closed by the deck lid panel 10. A spring, not shown, urges the panel 10 to the open position shown in FIG. 1.

The panel 10 may be latched in a closed position by a latch assembly, generally indicated at 22, which is mounted on the compartment panel 10. The latch assembly 22 includes a housing 24 having a latch bolt 26 pivotally mounted thereon. The latch bolt 26 is engageable with a striker 28 carried by the body panel 16 to latch and interconnect panel 10 with the body panel 16. The latch assembly 22 includes a latch bolt spring, not shown, which biases the latch bolt 26 to an unlatched position. When panel 10 is moved toward a closed position, the latch bolt 26 engages the striker 28 and is thereby pivoted to a latching position with respect to striker 28. The latch assembly 22 includes a detent lever, not shown, which maintains the latch bolt in the latched position with respect to the striker 28.

The latch assembly 22 also includes a key operated lock cylinder 30 which is rotatable when a properly bitted key is inserted. Rotation of the key cylinder pivots the detent lever out of engagement with the latch bolt 26 and permits the latch bolt spring to return the latch bolt to its unlatched position, thereby disconnecting the latch assembly 22 from the striker 28 and enabling the panel 10 to be moved to its open position by the compartment panel spring.

Figure 2:
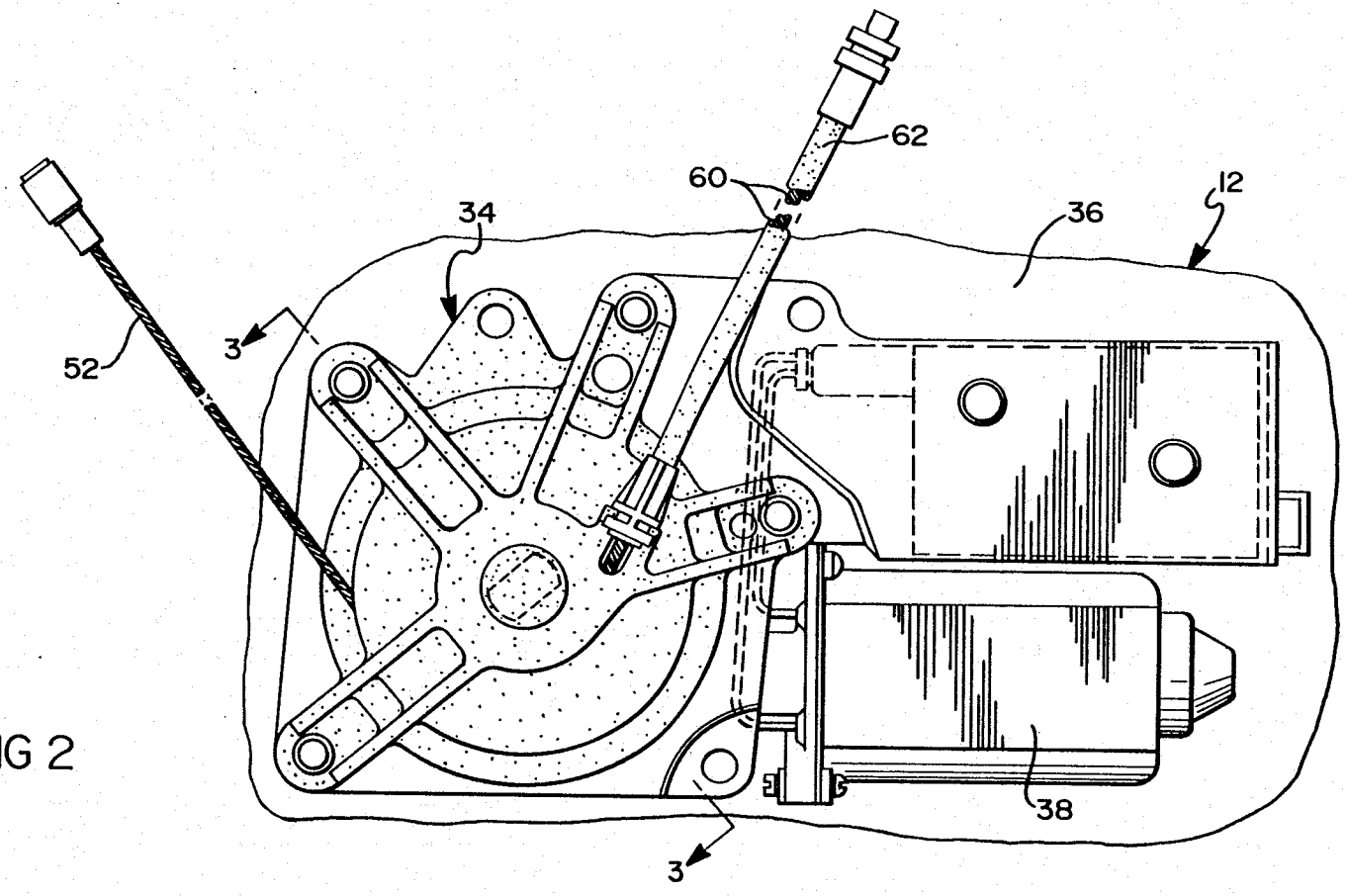
FIGS. 2–5 depict further views of the pull down mechanism of FIG. 1.

Referring again to FIG. 1, a motorized drive unit 34 is provided to pull down panel 10 to latch the latch assembly 22 with the striker 28 and to also pull down the striker 28 to seal the compartment panel 10 at its fully closed position. As best seen in FIG. 2, motorized pull down unit 34 is mounted on the side wall structure 36 of the vehicle body 12 and includes a motor 38 which reversibly rotates a cable drum 40, best shown in FIG. 3. The cable drum 40 is rotatably mounted inside a housing 42 by a shaft 44. A drive pinion 46 is connected to the motor 38 by a suitable gear transmission and meshes with teeth 48 provided on the inside of cable drum 40.

Figure 3:
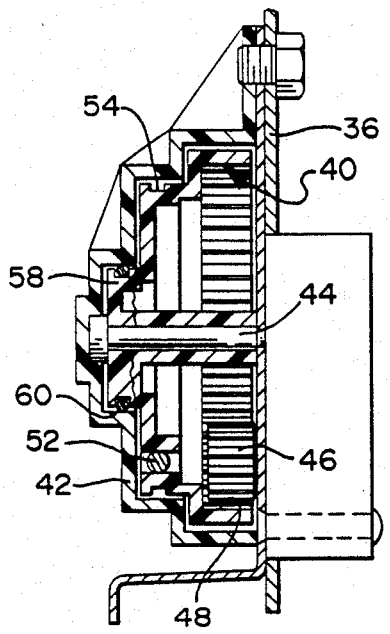

As seen in FIGS. 1, 2 and 3, a cable 52 is connected to an offset arm 53 of the panel hinge 14 and wraps around a pulley 54 of the cable drum 40. The innermost end of the cable 52 is anchored on the drum 40 so that rotation of the drum winds the cable 52. In particular, counterclockwise rotation of the drum 40, as viewed in FIG. 2, winds up the cable 52 and pulls the panel 10 down toward the closed position to perform the closing function.

The motorized drive unit also includes a second pulley 58 of the drum 40 which has a cable 60 attached thereto. As best seen by reference to FIG. 2, the cable 60 is wrapped around the drum 40 in the opposite direction of the cable 52 so that drum rotation in the direction to wind and retract cable 52 will extend the cable 60. The cable 60 is routed through a sheath 62 which extends to a pull down mechanism 64 for the striker 28.

Figure 4:
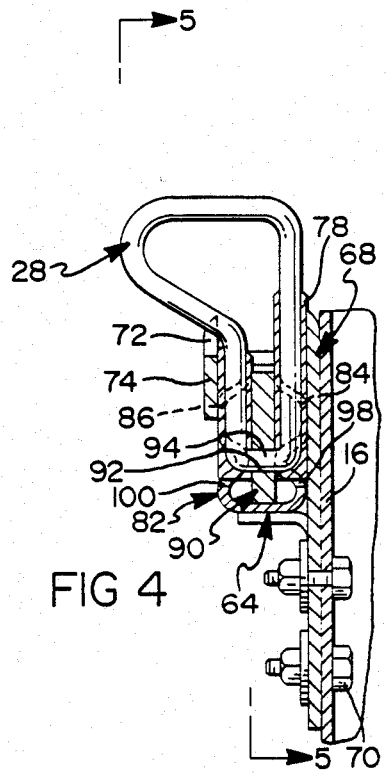
Figure 5:
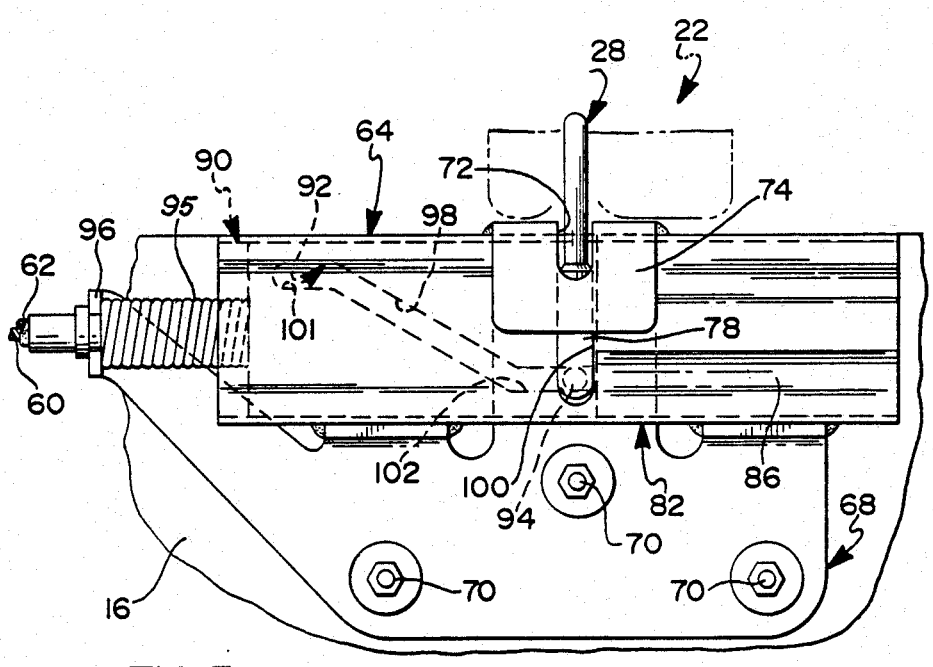

The pull down mechanism 64 for the striker 28 is shown in FIGS. 1, 4 and 5. The pull down mechanism includes a housing 68 bolted to the body panel 16. The striker 28 is defined by a bent rod and is captured within a slot 72 defined in a flange portion 74 of the housing 68. The bottom most portion of the striker 28 is encapsulated in the shoe 78 which is slidably captured between the housing 68 and flange 74 to mount the striker 28 for up and down movement. A U-shaped track 82 is mounted on the housing 68 and has upstanding legs 84 and 86 which slidably capture a slide member 90. As best seen in FIG. 5, the slide member 90 has a cam slot 92 therein which receives the lowermost leg 94 of the striker 28, thereby defining a cam follower which rides in the cam slot 92 of the slide member 90. The upstanding legs 84 and 86 of the U-shaped track 82 respectively have vertical extending slots 98 and 100 which receive the striker shoe 78 to further define the path of vertical up and down movement of the striker 28.

As best seen in FIG. 5, the cable 60 is attached to the slide member 90 so that clockwise rotation of the drum 40, as viewed in FIG. 2, will retract the cable 60 and pull the slide member 90 leftwardly, as viewed in FIG. 5. A coil compression spring 95 has one end seated against the slide member 90 and the other end seated against a stop 96 of the housing 68 to urge the slide member 90 rightwardly, as viewed in FIG. 5.

The cam slot 92 includes a central inclined portion 98, a horizontal dwell portion 100 at the upper end of the inclined portion 98 and a horizontal dwell portion 102 at the lower end of the inclined portion 98. The coil compression spring 95 normally positions the slide member 90 at the rightward position at which the dwell portion 100 of the cam slot 92 establishes the striker 28 at its upwardly extended position of FIGS. 1 and 5.

When a driver operated switch, schematically indicated in FIG. 6 by the reference numeral 218, is momentarily depressed to indicate that closure of the deck lid panel 10 is desired, the motor 38 is energized to rotate the drum 40 in a counterclockwise direction. This causes a momentary inrush of current to motor 38, as indicated by the reference numeral 120 in FIG. 7, which falls sharply as the motor 38 begins to rotate. As the motor 38 begins rotating, the drum 40 begins retracting cable 52 to initiate closure of the deck lid panel 10 and extending cable 60 to initiate vertical extension of the striker 28. During this load pick-up phase, the motor current rises, as indicated by the reference numeral 122 in FIG. 7, falling to a relatively steady level as the motor speed increases and stabilizes.

When the closing movement of the deck lid panel 10 carries the latch assembly 22 into engagement with the striker 28, the latch bolt 26 is rotated into latching engagement with the striker 28, thereby coupling the panel 10 with the striker 28. This significantly increases the mechanical load and produces a sharp rise in the motor current, as indicated by the reference numeral 124 in FIG. 7. As described below in reference to FIGS. **6*a*–6*b*, the pull down control unit of this invention detects the increased current associated with the latching and interrupts the motor current, as indicated by the reference numeral 126 in FIG. 7**.

After a brief pause, indicated by the reference numeral 128 in FIG. 7, the control unit energizes motor 38 in the opposite direction (clockwise) to reverse the direction of rotation of the drum 40. This causes a second momentary inrush of current to motor 38, as indicated by the reference numeral 130 in FIG. 7, which falls sharply as the motor 38 begins to rotate. As the motor 38 begins rotating, the cable 52 goes slack and the drum 40 begins retracting cable 60 to initiate vertical retraction of the striker 28 for sealing the panel 10 against the panel 16. During such movement, the motor current gradually rises, as indicated by the reference numeral 132 in FIG. 7, falling to a relatively steady level as the motor speed stabilizes.

When the slide member 90 reaches the full leftward position of FIG. 5, the dwell portion 102 of the cam slot 92 is engaged with the cam follower portion 94 of striker 28. At the end of such travel, the mechanical load reflected to motor 38 significantly increases, resulting in a sharp rise in the motor current, as indicated by the reference numeral 134 in FIG. 7. As described below in reference to FIGS. **6*a*–6*b*, the pull down control unit of this invention detects such increased current and interrupts the motor current as indicated by the reference numeral 136**.

Figure 6A:
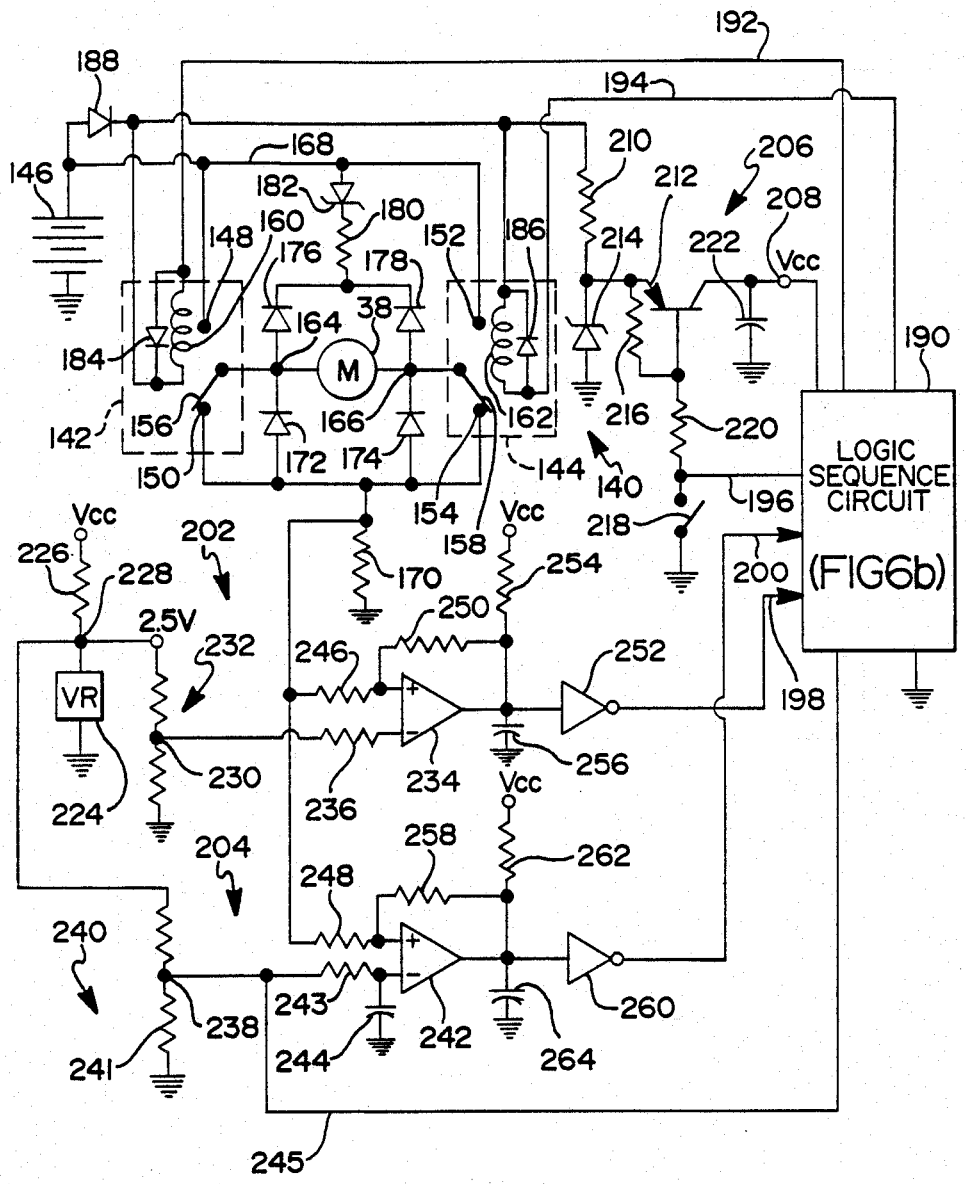
Figure 6B:
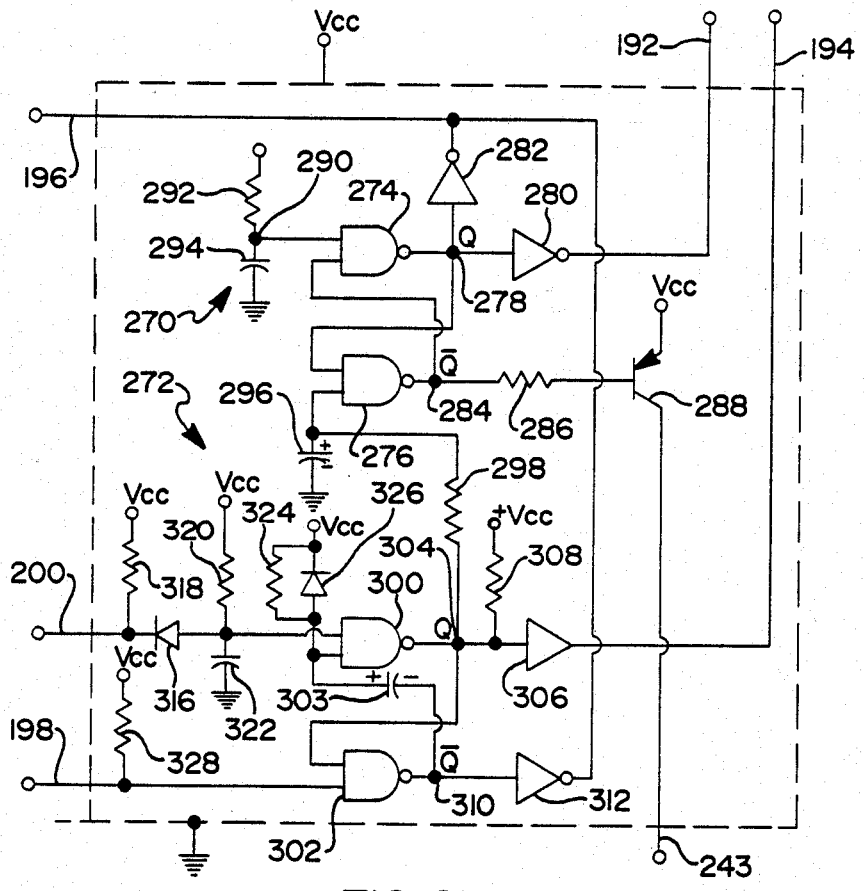

A control unit circuit for carrying out the control of this invention is schematically depicted in FIGS. **6*a*–6*b*. FIG. 6*a* depicts the overall circuit and FIG. 6*b* depicts a functional block of FIG. 6*a*** in greater detail.

Referring particularly to FIG. **6*a*, the reference numeral 140 generally designates a relay switching circuit connected to the motor terminals 164 and 166. The switching circuit 140 comprises a pair of single-pole double-throw relays 142, 144 controllable to bi-directionally energize the motor 38 with direct current from a conventional automotive storage battery 146. The relays 142, 144 each comprise a pair of contacts 148, 150; 152, 154, a switch arm 156, 158 spring biased to engage the lower contact 150, 154 as shown in FIG. 6*a*, and a coil 160, 162 energizable to overcome the spring bias, moving the switch arm 156, 158 into engagement with the upper contact 148, 152**.

The switch arm 156 of relay 142 is connected to the motor terminal 164 and the switch arm 158 of relay 144 is connected to the motor terminal 166. The upper relay contacts 148 and 152 are connected to the positive terminal of battery 146 via line 168. The lower relay contacts 150 and 154 are connected to ground potential and the negative terminal of battery 146 via the current shunt resistor 170.

In the normal or rest condition, the relays 142 and 144 connect both motor terminals 164 and 166 to ground potential via shunt resistor 170. When counterclockwise rotation of the motor 38 is required, the relay coil 160 is energized to bring switch arm 156 into engagement with the upper relay contact 148. This completes a first motor energization circuit comprising battery 146, relay contacts 148 and 154 and the shunt resistor 170. When clockwise rotation of the motor 38 is required, the relay coil 162 is energized to bring switch arm 158 into engagement with the upper relay contact 152. This completes a second motor energization circuit comprising battery 146, relay contacts 152 and 150 and the shunt resistor 170. When a relay coil 160, 162 is deenergized, the respective motor terminal 164, 166 is momentarily open-circuited. At such time, a snubber circuit comprising the freewheeling diodes 172–178, the resistor 180, and the Zener diode 182 operates to suppress high voltage transients by returning inductive energy stored in the motor windings to battery 146. The inductive energy stored in the relay coils 160, 162 upon their deenergization is circulated therethrough by a respective freewheeling diode 184, 186.

One terminal of each relay coil 160, 162 is connected to the positive terminal of battery 146 through the diode 188. The other terminals of relay coils 160 and 162 are connected to the LOGIC SEQUENCE CIRCUIT 190 via lines 192 and 194, which circuit selectively connects the lines 192 and 194 to ground potential for energizing the respective relay coils 160 and 162. In performing such control, the LOGIC SEQUENCE CIRCUIT 190 is responsive to a momentary grounding of line 196 and to the motor current limit signals on lines 198 and 200. The current limit signals on lines 198 and 200 are developed by the closing detection circuit 202 and the sealing detection circuit 204, respectively. The LOGIC SEQUENCE CIRCUIT 190 is shown in detail in FIG. 6*b*.

Operating voltage for the LOGIC SEQUENCE CIRCUIT 190 and the closing and sealing detection circuits 202 and 204, designated Vcc, is supplied by battery 146 via the wake-up circuit 206 at the junction 208. The junction 208 is connected to battery 146 via diode 188, resistor 210 and the emitter-collector circuit of transistor 212. The Zener diode 214 protects the transistor 212 from overvoltage transients and the resistor 216 biases transistor 212 to a normally nonconductive state.

A momentary contact switch 218 disposed in the passenger compartment of the vehicle is adapted to be depressed by the vehicle operator to initiate a deck lid pull down sequence. The switch 218 is connected to the base of wake-up circuit transistor 212 via resistor 220 and biases transistor 212 conductive to develop the operating voltage Vcc at junction 208 when depressed. As described below in reference to FIG. 6*b*, the LOGIC SEQUENCE CIRCUIT 190 senses the momentary depression of switch 218 via line 196 and operates under such condition to latch the transistor in a conductive state by maintaining line 196 substantially at ground potential. When the pull down sequence is completed, as indicated by the sealing detection circuit 204, the LOGIC SEQUENCE CIRCUIT 190 removes the bias and transistor 212 returns to its normally nonconductive state. Filter capacitor 220 prevents an abrupt loss of the operating voltage Vcc during the latching operation and at the end of the pull down sequence.

The voltage regulator circuit 224 is connected to operating voltage Vcc via resistor 226 and provides a precision voltage reference of 2.5 V at junction 228 for closing and sealing detection circuits 202 and 204. A voltage reference corresponding to a motor current of approximately 10 amperes (A) is generated at junction 230 by the voltage divider 232 and is supplied to the inverting input of closing detection circuit comparator 234 via resistor 236. A voltage reference corresponding to a motor current of approximately 5 A is generated at junction 238 by the voltage divider 240 and is supplied to the inverting input of sealing detection circuit comparator 242 via an RC timing circuit comprising the resistor 243 and the capacitor 244. In each case, the voltage reference is compared with the actual motor current as deduced by the voltage across shunt resistor 170, such voltage being supplied to the noninverting inputs of comparators 234 and 242 via resistors 246 and 248, respectively. As described below in reference to FIG. 6*b*, the reference voltage developed by divider 240 is subject to being overridden by the LOGIC SEQUENCE CIRCUIT 190 during the closing portion of the pull down sequence via the line 245.

The closing detection circuit 202 further includes a feedback resistor 250 and an inverter 252 connecting comparator 234 to the output line 198. When the actual motor current is lower than the 10 A reference defined by the divider 232, the comparator output is at a logic zero potential (low) and inverter 252 drives the output line 198 to a logic one potential (high). When the actual motor current exceeds the 10 A reference, the comparator output is high, and inverter 252 drives the output line 198 low to signal that the 10 A reference has been exceeded. An RC timing circuit comprising resistor 254 and capacitor 256 initializes the output line 198 to a high potential upon initial application of the operating voltage Vcc.

The sealing detection circuit 204 further includes a feedback resistor 258 and an inverter 260 connecting comparator 242 to the output line 200. When the actual motor current is lower than the 5 A reference defined by the divider 240, the comparator output is at a low potential, and inverter 260 drives the output line 200 to a high potential. When the actual motor current exceeds the 5 A reference, the comparator output is high, and inverter 260 drives the output line 200 low to signal that the 5 A reference has been exceeded. An RC timing circuit comprising resistor 262 and capacitor 264 initializes the output line 200 to a high potential upon initial application of the operating voltage Vcc.

Referring now to FIG. 6*b* and the LOGIC SEQUENCE CIRCUIT 190, control of the relay coil energization is performed by a pair of logical flip-flop circuits, designated by the reference numerals 270 and 272. Flip-flop circuit 270 energizes the relay coil 160 and overrides the 5 A sealing current reference when the operating voltage Vcc is initially supplied to begin the closing portion of the pull down sequence. Flip-flop circuit 272 is responsive to the current limit signals on output lines 198 and 200 for terminating the closing portion of the sequence and controlling activation of the sealing portion.

The flip-flop circuit 270 comprises a pair of cross-coupled NAND gates 274 and 276. The Q output at junction 278 is connected to the output line 192 via inverter 280 for controlling the energization of closing relay coil 160. The inverter 282, also connected to the Q output junction 278, provides a latching signal for wake-up circuit 206 on line 196 during the energization of solenoid coil 160. The Q-bar output at junction 284 is connected via resistor 286 to the base transistor 288, which operates when conductive to disable the sealing detection circuit reference by increasing it from 5 A to a value in excess of 10 A. The junction 290 of an RC timing circuit comprising the resistor 292 and the capacitor 294 is connected as an input to NAND gate 274 for ensuring an initial condition of the NAND gates 274 and 276 for performing the above-described functions on initial application of the operating voltage Vcc. An RC timing circuit comprising the capacitor 296 and the resistor 298 couple the flip-flop circuits 270 and 272 as explained below to provide a controlled pause between the closing and sealing portions of the pull down sequence.

The flip-flop circuit 272 also comprises a pair of cross-coupled NAND gates 300 and 302. A coupling capacitor 303 serves to engage the sealing portion of the pull down sequence if the motor current fails to reach the closing current reference, as explained below. The Q output at junction 304 is connected to the output line 194 via buffer amplifier 306 for controlling the energization of sealing relay coil 162, and also to the NAND gate 276 via line 298 for controlling the transition between the closing and sealing portions of the pull down sequence. The pull-up resistor 308 provides a normally high input for amplifier 306. The Q-bar output at junction 310 is connected as an input to inverter 312, which provides a latching signal for wake-up circuit 206 on line 196 during the energization of relay coil 162.

The operation of flip-flop circuit 172 is controlled by the sealing and closing current limit signals on output lines 200 and 198. The line 200 is connected as an input to NAND gate 300 via diode 316, the pull-up resistor 318 providing a normally high input level. An RC timing circuit comprising the resistor 320 and the capacitor 322 provide an initial override of the sealing current limit signal so that flip-flop circuit 272 is insensitive to the inrush and initial load pick-up current which occurs at the initiation of motor operation. The other input of NAND gate 300 is normally maintained high by the parallel combination of pull-up resistor 324 and diode 326 which isolates the coupling capacitor 303. The line 198 is connected directly as an input to the NAND gate 302, the pull-up resistor 328 providing a normally high input level.

The operation of the control circuit of this invention for a typical deck lid pull down sequence will now be described. The sequence begins with momentary depression of switch 218 by the operator of the vehicle, which biases wake-up circuit transistor 212 conductive to develop operating voltage Vcc at junction 208. At such point, the Q outputs of flip-flop circuits 270 and 272 both assume a high potential, thereby (1) latching transistor 212 conductive via inverter 282, (2) energizing closing relay coil 160 via inverter 280, and (3) overriding the sealing current reference via transistor 288. In addition, the capacitor 296 charges to the indicated polarity.

The RC timing circuit comprising resistor 320 and capacitor 322 prevents flip-flop circuit 272 from changing states during the inrush and initial load pick up phase of the closing, designated by the reference numerals 120 and 122 in FIG. 7, even though the motor current during such phase exceeds the closing circuit reference of 10 A. In a mechanization of the present invention, an RC time constant of 1.8 seconds was found to be adequate. Following such delay, the motor current should be well below the 10 A reference. When the deck lid panel 10 has been sufficiently closed to mechanically couple the striker 28 and latch bolt 26, the motor current rises, as designated by the reference numeral 124 in FIG. 7.

When the motor current exceeds the closing detection circuit reference of 10 A, the output of inverter 252 on feedback line 198 goes low, reversing the output state of flip-flop circuit 272. At such time, amplifier 306 goes low to energize the sealing relay coil 162 and capacitor 296 begins discharging through the resistor 297. The flip-flop circuit 270 remains in its initial state until the voltage across capacitor 296 falls to a logic zero potential. As a result, the relay coils 160 and 162 are concurrently energized, connecting both motor terminals 164 and 166 to the same potential. This establishes a delay interval, as designated by the reference numeral 128 in FIG. 7.

When capacitor 296 is sufficiently discharged, the flip-flop circuit 272 changes state, deenergizing the closing relay coil 160 and biasing transistor 288 nonconductive. The wake-up transistor 212 is maintained conductive at such point by the inverter 312 of flip-flop circuit 272. At such time, the motor 38 is energized to rotate in the clockwise direction, resulting in the inrush current designated by the reference numeral 130 in FIG. 7. However, the current reference of the sealing detection circuit 204 is maintained relatively high by the capacitor 244, and the reference is not returned to its nominal 5 A level until the higher capacitor voltage is discharged through the resistors 241 and 243. By that time, the motor current will have stabilized as indicated in FIG. 7. Thereafter, the sealing detection circuit 204 compares the motor current with the 5 A reference defined by the divider 240.

As the cam follower portion of striker 28 reaches the end of travel in cam slot 92, the motor current increases above the 5 A reference current, as designated by the reference numeral 134 in FIG. 7. At such time, the comparator 242 changes state and the output of inverter 260 falls to a low potential to change the state of flip-flop circuit 272. This deenergizes the sealing relay coil 162 and unlatches the wake-up circuit transistor 212, completing the pull down sequence.

If the control circuit is operated with the battery 146 in a near-discharged condition, it is possible that the 10 A closing reference defined by the divider 232 will never be exceeded. In such event, the capacitor 303 will become sufficiently charged to independently change the state of the flip-flop circuit 272, thereby initiating the sealing portion of the sequence. In a mechanization of the illustrated circuit, an RC time constant (resistor 324, capacitor 303) of approximately 10 seconds was found to be satisfactory.

In view of the above, it will be seen that the control circuit of this invention provides inherent obstacle detection. If the panel 10 encounters an obstruction in the closing portion of the pull down sequence, for example, the increased load will cause the motor current to exceed the 10 A reference defined by the divider 232. This will result in a reversal of the motor 38 just as though the striker 28 and latch bolt 26 had been coupled. Thus, the cable 52 will extend, allowing the panel to raise to its normal open position. Subsequent depression of the switch 218 will initiate a new pull down sequence.

In the manner described above, the control of this invention operates a compartment panel pull down mechanism, including obstruction detection, without the use of limit switches. While the control of this invention has been described in reference to the illustrated embodiment, this invention is not limited thereto. Various modifications may occur to those skilled in the art, and it will be understood that controls incorporating such modifications may fall within the scope of this invention, which is defined by the appended claims.

The embodiments of the invention in which an exclusive property or privilege is claimed are defined as follows:

1. In a vehicle body having a compartment panel hinged for movement between open and closed positions with respect to a compartment defined by a body panel, a latch mechanism including a first element fixedly mounted on one of said panels and a second element retractably mounted on the other panel, and a pull down mechanism including an electric motor adapted to sequentially (1) move the compartment panel to a partially closed position for mechanically coupling the first and second elements of said latch mechanism, and (2) retracting the second element of said latch mechanism in the direction of such compartment panel movement to complete the closure of said panel, motor control apparatus, comprising:

switch means activated by a vehicle operator to generate a panel closure command;

first control means effective in response to the generation of said panel closure command by said switch means for supplying current to said motor in a direction which moves said compartment panel toward said partially closed position; and second control means effective when the motor current supplied by said first control means exceeds a closing reference indicative of successful coupling of said latch mechanism elements for interrupting the supply of current by said first control means, and thereafter, supplying current to said motor in a direction to retract the second element of said latch mechanism until such current exceeds a sealing reference indicative of complete closure of said panel, thereby to sequentially control the operation of said motor without the use of mechanically activated limit switches.

2. The apparatus set forth in Claim 1, further comprising:

means for disabling the interruption of motor current by said second control means for a predetermined interval following the generation of said panel closure command by said switch means, thereby to prevent such interruption of motor current in response to an inrush of motor current at the initiation of the current supply.

3. In a vehicle body having a compartment panel hinged for movement between open and closed positions with respect to a compartment defined by a body panel, a latch mechanism including a first element fixedly mounted on one of said panels and a second element retractably mounted on the other panel, and a pull down mechanism including an electric motor adapted to sequentially (1) move the compartment panel to a partially closed position for mechanically coupling the first and second elements of said latch mechanism, and (2) retracting the second element of said latch mechanism in the direction of such compartment panel movement to complete the closure of said panel, motor control apparatus, comprising:

switch means activated by a vehicle operator to generate a panel closure command;

first control means effective in response to the generation of said panel closure command by said switch means for supplying current to said motor in a direction which moves said panel toward said partially closed position;

motor current limit detection means including means defining a first reference representative of a motor current which will occur upon mechanical coupling of said latch mechanism elements, means defining a second reference representative of a motor current which will occur upon complete closure of said compartment panel, means for generating a first limit signal when the actual motor current exceeds said first reference, and means for generating a second limit signal when the actual motor current exceeds said second reference; and second control means triggered in response to the generation of said first limit signal by said motor current limit detection means for interrupting the supply of current by said first control means, and supplying current to said motor in a direction to retract the second element of said latch mechanism until the generation of said second limit signal by said motor current limit detection means, whereafter all motor current is interrupted.

4. The apparatus set forth in claim 3, wherein the first reference is greater than the second reference, and the first control means includes override means for disabling the generation of said second limit signal during the supply of current by said first control means.

5. The apparatus set forth in claim 4, wherein the override means includes means for increasing the first reference above the second reference during the supply of current by said first control means.

6. The apparatus set forth in claim 4, further comprising:

means defining a relatively long time interval beginning with the generation of the panel closure command by said switch means; and means effective if said first limit signal is not generated within said relatively long time interval for independently triggering said second control means to interrupt the supply of current by the first control means.

7. In a vehicle body having a compartment panel hinged for movement between open and closed positions with respect to a compartment defined by a body panel, a latch mechanism including a first element fixedly mounted on one of said panels and a second element retractably mounted on the other panel, and a pull down mechanism including an electric motor adapted to sequentially (1) move the compartment panel to a partially closed position for mechanically coupling the first and second elements of said latch mechanism, and (2) retracting the second element of said latch mechanism in the direction of such compartment panel movement to complete the closure of said panel, motor control apparatus, comprising:

motor energization control means including a source of direct current having two terminals of opposite polarity, first and second switch means independently controllable to connect first and second terminals of said motor to either terminal of said source;

first control means effective when it is desired to close said compartment panel for controlling said first and second switch means to connect the first and second motor terminals to the opposite polarity terminals of said source such that the current thereby supplied to said motor produces motor rotation in a direction which moves said compartment panel toward said partially closed position; and second control means effective when the motor current supplied by said first control means exceeds a closing reference indicative of successful coupling of said latch mechanism elements for sequentially controlling said first and second switch means to connect the first and second motor terminals (1) to the same terminal of said source to thereby interrupt the supply of current established by said first control means, and following a predetermined delay, (2) to opposite polarity terminals of said source such that the current thereby supplied to said motor produces motor rotation in a direction which retracts the second element of said latch mechanism, and once such current exceeds a sealing reference indicative of complete closure of said compartment panel, (3) to the same terminal of said source to thereby interrupt the supply of such current, whereby the operation of said motor is controlled without the use of mechanically activated limit switches.

8. In a vehicle body having a compartment panel hinged for movement between open and closed positions with respect to a compartment defined by a body panel, a latch mechanism including a first element fixedly mounted on one of said panels and a second element retractably mounted on the other panel, and a pull down mechanism including an electric motor adapted to sequentially (1) move the compartment panel to a partially closed position for mechanically coupling the first and second elements of said latch mechanism, and (2) retracting the second element of said latch mechanism in the direction of such compartment panel movement to complete the closure of said compartment panel, a method of operating said electric motor in response to a commanded closing of said compartment panel, such method comprising the steps of:

energizing said motor with current in a direction to move said compartment panel toward said partially closed position for coupling the first and second elements of said latch mechanism;

monitoring such current, at least during a steady state phase of said energization following the initial inrush of current to said motor;

interrupting the energization of said motor when the monitored current exceeds a closing reference defined in relation to the magnitude of current typically drawn by the motor following the coupling of said first and second elements of said latch mechanism;

energizing said motor with current in a direction to retract the second element of said latch mechanism for moving said compartment panel toward said fully closed position;

monitoring such current, at least during a steady state phase of said energization following the initial inrush of current to said motor; and interrupting the energization of said motor when the monitored current exceeds a sealing reference defined in relation to the magnitude of current typically drawn by the motor after the compartment panel has attained its fully closed position.

* * * * *